US008220078B2

(12) United States Patent
Wang

(10) Patent No.: US 8,220,078 B2
(45) Date of Patent: Jul. 17, 2012

(54) SAFETY HELMET AND MANUFACTURING METHOD THEREOF

(76) Inventor: Tse-Ping Wang, Taipei (TW)

( * ) Notice: Subject to any disclaimer, the term of this patent is extended or adjusted under 35 U.S.C. 154(b) by 1103 days.

(21) Appl. No.: 12/068,476

(22) Filed: Feb. 7, 2008

(65) Prior Publication Data

US 2009/0158507 A1 Jun. 25, 2009

(30) Foreign Application Priority Data

Dec. 25, 2007 (TW) ..... 96149831 A

(51) Int. Cl.
*A42B 3/12* (2006.01)

(52) U.S. Cl. ..... 2/414; 2/410; 2/411; 2/412

(58) Field of Classification Search ..... 2/455, 410, 2/411, 412, 414
See application file for complete search history.

(56) References Cited

U.S. PATENT DOCUMENTS 5,012,533 A * 5/1991 Raffler ..... 2/420
5,088,130 A * 2/1992 Chiarella ..... 2/411
2007/0220662 A1 * 9/2007 Pierce ..... 2/410

* cited by examiner

*Primary Examiner* — Christopher Harmon
(74) *Attorney, Agent, or Firm* — Bacon & Thomas, PLLC

(57) ABSTRACT

This specification discloses an integrally formed safety helmet. A pre-cast hard outer shell is directly filled with Styrofoam particles followed by heating and pressing to form a soft inner shell. The two shells are integrally formed and tightly connected with no space in between. The production procedure includes the steps of: putting a pre-cast hard outer shell in an upper mold; combining the upper mold and a lower mold; heating the molds to soften a compound material outer shell; pressing to squeeze out extra resin in the compound material outer shell; cooling down the molds and injecting Styrofoam particles into the cavity in the molds, foaming, pressing, and lowering the temperature; and removing the molds. The soft inner shell is then integrally formed inside the hard outer shell.

15 Claims, No Drawings

SAFETY HELMET AND MANUFACTURING METHOD THEREOF

BACKGROUND OF THE INVENTION

1. Field of Invention

The invention relates to an integrally formed helmet and the manufacturing method thereof. In particular, the invention relates to a safety helmet for bicycle or car racing and the manufacturing method thereof.

2. Related Art

Current safety helmets for bicycle or car racing are roughly the same in their structures. The outer shell is usually hard and made of compound materials such as PC, ABS, carbon fibers, glass fibers, and kevlar. In the hard shell is filled with a light and soft material layer that is in direct contact with the user's head. When a collision occurs, the soft inner shell is responsible for absorbing the impact.

The manufacturing method for the above-mentioned safety helmet involves filling Styrofoam particles inside the outer shell, followed by heating and pressing them to form an inner shell. The outer surface of the Styrofoam shell is then taped and attached onto the outer hard shell. The inner surface of the Styrofoam shell is decorated with a soft cotton layer so that the head is not in direct contact with the rough Styrofoam and the Styrofoam surface is also protected. However, the procedure is complicated and more expensive.

Moreover, the hard outer shell and the Styrofoam inner shell are often connected by buckle belts. It is very likely to have a gap between and thus for them to separate from each other. In a collision, the impact is not uniformly distributed to effectively protect the user's head.

If the hard outer shell is made of compound materials such as carbon fibers, glass fibers, and kevlar, it is usually formed by coating a resin on a synthetic fiber cloth. This results in a larger space between fibers. The use of resin also increases the overall weight.

The above-mentioned techniques have been disclosed in PROC Pat. Nos. 93104671.8, 95115447.8, and 03825759.9.

SUMMARY OF THE INVENTION

An objective of the invention is to solve the problems in the existing technology. According to the invention, a hard outer shell is directly filled with Styrofoam particles lie expanded polystyrene) after an upper mold and a lower mold are combined. The expanded polystyrene particles are then heated and pressed to form an outer shell. The outer hard shell and the buffering inner shell are integrally formed and tightly connected without any gap in between. The safety helmet thus formed has a lower production cost.

Another objective of the invention is provides a safety helmet with a hard outer shell and a buffering inner shell integrally formed and tightly connected without any gap in between by heating and pressing Styrofoam particles directly filled in the outer shell. The disclosed safety helmet has a better effect in distributing the impact received by the helmet during a collision.

According to an embodiment of the invention, the inner shell is formed by filling a hard outer shell with Styrofoam particles after an upper mold and a lower mold are combined, followed by heating and pressing the Styrofoam particles. Extra resin in the compound material outer shell is squeezed out to form a tight connection between the hard outer shell and the buffering inner shell without any gap in between. The disclosed safety helmet has a lighter weight and can withstand a larger impact.

DETAILED DESCRIPTION OF THE INVENTION

The present invention will be apparent from the following detailed description.

According to an embodiment of the invention, a pre-cast hard outer shell is inserted into an upper mold. The upper mold is then combined with a lower shell. Afterwards, the cavity in the molds is injected with Styrofoam particles, followed by heating, foaming, pressing, and cooling. A feature of the invention is that the Styrofoam is directly injected, heated, and pressed to form an inner shell. During this process, extra resin in the compound material outer shell is squeezed out. Therefore, a safety helmet with tightly connected hard outer shell and buffering inner shell is integrally formed with any gap in between.

The invention has the following obvious advantages:

(1) The Styrofoam inner shell and the hard outer shell are connected inside the molds. In this case, the pre-cast hard outer shell is mounted in the upper mold. The Styrofoam particles are injected, heated, foamed, pressed, and cooled inside the cavity of the combined molds. Extra resin of the compound material outer shell is squeezed out to form a tight connection without any gap in between. This avoids the procedure of taping the Styrofoam inner shell and inserting it into the outer shell. Therefore, the invention saves time, efforts, and material costs.

(2) Since there is no gap between the inner and outer shells, the impact received by the helmet during a collision can be more uniformly distributed to protect the user's head.

(3) Extra resin contained in the outer shell is removed. Therefore, the weight of the helmet is reduced. This renders a tighter and stronger connection between the compound materials, enhancing the protection and withstanding power of the helmet.

According to the disclosed manufacturing method, a pre-cast hard outer shell is directly filled with Styrofoam particles. They are heated and pressed to form an inner shell. The safety helmet thus integrally formed has no gap between the hard outer shell and the buffering inner shell. It is lighter than conventional helmet by 100-500 g. The procedure is described as follows.

A pre-cast hard outer shell is mounted in an upper mold. The upper mold is then combined with a lower mold. The molds are heated to 110° C.-360° C. in order to soften the compound material of the outer shell. A pressure of 1.2 bars is imposed to squeeze out extra resin in the compound material outer shell. Afterwards, the temperature is cooled down to 110° C. The cavity in the combined molds is filled with Styrofoam particles, followed by foaming and pressing to 0.8-0.95 bar. The inner shell molding process is finished in 386 seconds. The molds are separated after 10 seconds of water cooling.

Embodiment 1

A hard ABS outer shell is mounted in the upper mold. The upper mold is then combined with a lower mold. The molds are heated to 110° C. The cavity in the combined molds is filled with Styrofoam particles, followed by foaming and pressing to 0.8-0.95 bar. The inner shell molding process is finished in 386 seconds. The molds are separated after 10 seconds of water cooling.

Embodiment 2

A hard PC outer shell is mounted in the upper mold. The upper mold is then combined with a lower mold. The molds are heated to 110° C. The cavity in the combined molds is filled with Styrofoam particles, followed by foaming and pressing to 0.8-0.95 bar. The inner shell molding process is finished in 386 seconds. The molds are separated after 10 seconds of water cooling.

Embodiment 3

A hard outer shell made of a carbon fiber compound material is mounted in the upper mold. The upper mold is then combined with a lower mold. The molds are heated to 110° C.-360° C. in order to soften the compound material of the outer shell. A pressure of 1.2 bars is imposed to squeeze out extra resin in the compound material outer shell. Afterwards, the temperature is cooled down to 110° C. The cavity in the combined molds is filled with Styrofoam particles, followed by foaming and pressing to 0.8-0.95 bar. The inner shell molding process is finished in 386 seconds. The molds are separated after 10 seconds of water cooling.

Embodiment 4

A hard outer shell made of a glass fiber compound material is mounted in the upper mold. The upper mold is then combined with a lower mold. The molds are heated to 110° C.-360° C. in order to soften the compound material of the outer shell. A pressure of 1.2 bars is imposed to squeeze out extra resin in the compound material outer shell. Afterwards, the temperature is cooled down to 110° C. The cavity in the combined molds is filled with Styrofoam particles, followed by foaming and pressing to 0.8-0.95 bar. The inner shell molding process is finished in 386 seconds. The molds are separated after 10 seconds of water cooling.

Embodiment 5

A hard outer shell made of the compound material of carbon fibers, glass fibers, and kevlar is mounted in the upper mold. The upper mold is then combined with a lower mold. The molds are heated to 110° C.-360° C. in order to soften the compound material of the outer shell. A pressure of 1.2 bars is imposed to squeeze out extra resin in the compound material outer shell. Afterwards, the temperature is cooled down to 110° C. The cavity in the combined molds is filled with Styrofoam particles, followed by foaming and pressing to 0.8-0.95 bar. The inner shell molding process is finished in 386 seconds. The molds are separated after 10 seconds of water cooling.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A manufacturing method of an integrally formed safety helmet, comprising the steps of:

(a) mounting a pre-cast hard outer shell in an upper mold;

(b) combining the upper mold with a lower mold, and preheating, pressing, and cooling the combined molds;

(c) injecting expanded polystyrene particles into the cavity in the combined molds, and heating, foaming, pressing, and molding the expanded polystyrene particles to form an integral inner foamed lining; and (d) cooling and separating the molds.

2. The manufacturing method of an integrally formed safety helmet of claim 1, wherein the molds are preheated to 110° C.-360° C.

3. The manufacturing method of an integrally formed safety helmet of claim 1, wherein the molds are imposed by a pressure of 1.2 bars to squeeze out extra resin and reduce its weight.

4. The manufacturing method of an integrally formed safety helmet of claim 1, wherein the hard outer shell is made of PC.

5. The manufacturing method of an integrally formed safety helmet of claim 1, wherein the hard outer shell is made of ABS.

6. The manufacturing method of an integrally formed safety helmet of claim 1, wherein the hard outer shell is made of a compound material of carbon fibers.

7. The manufacturing method of an integrally formed safety helmet of claim 1, wherein the hard outer shell is made of a compound material of glass fibers.

8. The manufacturing method of an integrally formed safety helmet of claim 1, wherein the hard outer shell is made of a compound material of kevlar.

9. The manufacturing method of an integrally formed safety helmet of claim 1, wherein the hard outer shell is made of a compound material of Kevlar and carbon fibers.

10. The manufacturing method of an integrally formed safety helmet of claim 1, wherein the hard outer shell is made of a compound material of kevlar and glass fibers.

11. The manufacturing method of an integrally formed safety helmet of claim 1, wherein the hard outer shell is made of a compound material of glass fibers and carbon fibers.

12. The manufacturing method of an integrally formed safety helmet of claim 1, wherein the hard outer shell is made of a compound material of kevlar, glass fibers, and carbon fibers.

13. The manufacturing method of an integrally formed safety helmet of claim 1, wherein the material of the expanded polystyrene particles is a mixture of substances with different strengths.

14. The manufacturing method of an integrally formed safety helmet of claim 1, wherein the cooling method is natural cooling.

15. The manufacturing method of an integrally formed safety helmet of claim 1, wherein the cooling method is water cooling.

* * * * *